US012030685B2

(12) United States Patent
Fujita et al.

(10) Patent No.: US 12,030,685 B2
(45) Date of Patent: Jul. 9, 2024

(54) BAG-MAKING AND PACKAGING MACHINE

(71) Applicant: ISHIDA CO., LTD., Kyoto (JP)

(72) Inventors: Kento Fujita, Ritto (JP); Shinji Koike, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 5 days.

(21) Appl. No.: 17/492,677

(22) Filed: Oct. 4, 2021

(65) Prior Publication Data

US 2022/0111988 A1 Apr. 14, 2022

(30) Foreign Application Priority Data

Oct. 14, 2020 (JP) ..... 2020-173341

(51) Int. Cl.

| | |
|---|---|
| ***B65B 57/12*** | (2006.01) |
| ***B65B 9/20*** | (2012.01) |
| ***B65B 37/18*** | (2006.01) |
| ***B65B 41/16*** | (2006.01) |
| ***B65B 51/26*** | (2006.01) |
| ***B65B 61/06*** | (2006.01) |

(52) U.S. Cl.

CPC ..... *B65B 57/12* (2013.01); *B65B 9/20* (2013.01); *B65B 37/18* (2013.01); *B65B 41/16* (2013.01); *B65B 51/26* (2013.01); *B65B 61/06* (2013.01)

(58) Field of Classification Search

CPC ..... B65B 57/12; B65B 9/20; B65B 37/18; B65B 41/16; B65B 51/26; B65B 61/06

USPC ..... 53/74

See application file for complete search history.

(56) References Cited

U.S. PATENT DOCUMENTS 6,401,437 B1 * 6/2002 Kono ..... B65B 57/12 53/502

2019/0127092 A1 5/2019 Ichikawa et al.

FOREIGN PATENT DOCUMENTS

| | | | |
|---|---|---|---|
| JP | 2001-004436 | A | 1/2001 |
| JP | 2006131267 | A | 5/2006 |
| JP | 2020079114 | A | 5/2020 |
| WO | 2017104229 | A1 | 6/2017 |

OTHER PUBLICATIONS

Search Report from the corresponding European Patent Application No. 21200439.4 issued on Mar. 15, 2022.

* cited by examiner

*Primary Examiner* — Valentin Neacsu
*Assistant Examiner* — Mary C Hibbert-Copeland
(74) *Attorney, Agent, or Firm* — United IP Counselors, LLC

(57) ABSTRACT

A bag-making and packaging machine works with a weighing machine installed upstream to manufacture bags containing article discharged from the weighing machine. The bag-making and packaging machine includes a forming unit, a transverse sealing unit, a conveyance unit, a communication unit, and a control unit. The communication unit receives from the weighing machine a signal relating to weighing and discharge of the article. The control unit has a disposal mode for disposing of the article in the weighing machine. When changing from a normal production mode to the disposal mode, the control unit performs control to skip, among operations in the normal production mode, the operation of the transverse sealing unit implemented in conjunction with the signal received by the communication unit from the weighing machine.

9 Claims, 4 Drawing Sheets

BAG-MAKING AND PACKAGING MACHINE

CROSS-REFERENCE TO RELATED APPLICATIONS

This application claims priority to Japanese Patent Application No. 2020-173341, filed Oct. 14, 2020. The contents of that application are incorporated by reference herein in their entirety.

TECHNICAL FIELD

This invention relates to a bag-making and packaging machine.

BACKGROUND ART

As disclosed in JP-A No. 2001-4436, a weighing, bag-making, and packaging system is known where an article discharged from a weighing device is packaged by a bag-making and packaging machine to thereby manufacture bags containing the article. In a case where, even after repeating a predetermined number of times the operation of supplying the article to the weigh hoppers, a combination is not reached and weigh hoppers cannot be selected, the weighing, bag-making, and packaging system of patent document 1 is automatically switched to a total discharge process that forcibly discharges the article that is in all the weigh hoppers.

BRIEF SUMMARY

However, in JP-A No. 2001-4436, when there are a lot of articles in the weigh hoppers, there have been cases where clogging occurs inside the bag-making and packaging machine when the total discharge process is implemented. Furthermore, there has been room for improvement in terms of the use amount of the film that contains the forcibly discharged articles.

It is a problem of this invention to provide a bag-making and packaging machine which, when discharging an article in a weighing machine, inhibits the article from getting clogged and reduces the used amount of film.

A bag-making and packaging machine pertaining to a first aspect works with a weighing machine installed upstream to manufacture a bag containing an article discharged from the weighing machine. The bag-making and packaging machine includes a forming unit, a transverse sealing unit, a conveyance unit, a communication unit, and a control unit. The forming unit forms a film into a tubular shape. The transverse sealing unit transversely seals the film that has been formed into the tubular shape. The conveyance unit conveys the film. The communication unit receives from the weighing machine a signal relating to weighing and discharge of the article. The control unit has a disposal mode for disposing of the article in the weighing machine. When changing from a normal production mode to the disposal mode, the control unit performs control to skip, among operations in the normal production mode, the operation of the transverse sealing unit implemented in conjunction with the signal received by the communication unit from the weighing machine.

According to the bag-making and packaging machine of the first aspect, the control unit of the bag-making and packaging machine has the disposal mode for disposing of the article in the weighing machine, and the control unit performs control so that the article is discharged in the normal production mode from the weighing machine when changing to the disposal mode. For this reason, the article can be inhibited from getting clogged inside the bag-making and packaging machine. Consequently, when discharging the article in the weighing machine, the article can be inhibited from getting clogged.

Furthermore, when changing to the disposal mode, the control unit performs control to skip the operation of the transverse sealing unit. For this reason, compared to the normal production mode, a lot of the articles discharged from the weighing machine can be accommodated. Consequently, when discharging the article in the weighing machine, the use amount of the film can be reduced.

Thus, the bag-making and packaging machine of the first aspect can, when discharging the article in the weighing machine, inhibit the article from getting clogged and reduce the use amount of the film.

A bag-making and packaging machine of a second aspect is the bag-making and packaging machine pertaining to the first aspect, wherein when the disposal mode has been set, the control unit performs control to skip a predetermined number of times the operation of conveying the film that is linked to the signal.

In the bag-making and packaging machine of the second aspect, in the disposal mode the control unit performs control to skip a predetermined number of times the operation of conveying the film, so more of the articles to be disposed of can be accommodated in the film than in the normal production mode (in normal operation). For this reason, the use amount of the film in the disposal mode can be reduced.

A bag-making and packaging machine pertaining to a third aspect is the bag-making and packaging machine pertaining to the first aspect or the second aspect, wherein when the disposal mode has been set, the control unit controls, in conjunction with the signal, the transverse sealing unit to suspend the transverse sealing operation for a fixed period of time or skip the transverse sealing operation a predetermined number of times.

In the bag-making and packaging machine of the third aspect, in the disposal mode the transverse sealing operation is performed fewer times than it is in normal operation, so one or more bags that is longer than that is in normal operation can be manufactured. For this reason, the bags manufactured in the disposal mode can be easily distinguished.

A bag-making and packaging machine pertaining to a fourth aspect is the bag-making and packaging machine pertaining to the first aspect to the third aspect, further including an input unit that sets the disposal mode.

In the bag-making and packaging machine of the fourth aspect, the disposal mode can be set by the input unit. For this reason, a user can easily realize the disposal mode.

A bag-making and packaging machine pertaining to a fifth aspect is the bag-making and packaging machine pertaining to the fourth aspect, wherein the input unit allows a user to input the number of times that the transverse sealing operation by the transverse sealing unit is to be stopped.

In the bag-making and packaging machine of the fifth aspect, in the disposal mode the number of times that the transverse sealing operation is to be stopped can be selected. For example, when the number of times that the transverse sealing operation is to be stopped is one time or more in a range in which clogging is inhibited, one or more bags that are longer than they are in normal operation can be manufactured.

A bag-making and packaging machine pertaining to a sixth aspect is the bag-making and packaging machine pertaining to the fourth aspect or the fifth aspect, wherein the input unit allows a user to input the weight per discharge of the article from the weighing machine.

In the bag-making and packaging machine of the sixth aspect, in the disposal mode the weight in which the article is to be discharged from the weighing machine can be selected. For example, when the weight is about the same as it is in normal operation, clogging can be further inhibited. Furthermore, for example, when the weight is greater than it is in normal operation in a range in which clogging is inhibited, the use amount of the film can be reduced.

A bag-making and packaging machine pertaining to a seventh aspect is the bag-making and packaging machine pertaining to the fourth aspect to the sixth aspect, wherein the input unit allows a user to input the number of times per bag that the article is to be discharged from the weighing machine.

In the bag-making and packaging machine of the seventh aspect, in the disposal mode the number of times that the article is to be discharged from the weighing machine can be selected. For example, when the number of times is the same as it is in normal operation, clogging can be further inhibited. Furthermore, for example, when the number of times is greater than it is in normal operation in a range in which clogging is inhibited, the use amount of the film can be further reduced.

A bag-making and packaging machine pertaining to an eighth aspect is the bag-making and packaging machine pertaining to the fourth aspect to the seventh aspect, further including a cutting unit that cuts the portion of the film that the transverse sealing unit has transversely sealed. The input unit allows a user to input the frequency of the cutting operation by the cutting unit.

In the bag-making and packaging machine of the eighth aspect, in the disposal mode the frequency of the cutting operation can be selected. For example, when the cutting frequency is the same as it is in normal operation, clogging can be further inhibited. Furthermore, for example, when the cutting frequency is higher than it is in normal operation in a range in which clogging is inhibited, one or more bags that are longer than they are in normal operation can be manufactured.

A bag-making and packaging machine pertaining to a ninth aspect is the bag-making and packaging machine pertaining to the fourth aspect to the eighth aspect, wherein the input unit allows a user to input the amount of the film that is to be fed, and/or the speed at which the film is to be fed, by the conveyance unit.

In the bag-making and packaging machine of the ninth aspect, in the disposal mode the amount of the film to be fed and/or the speed at which the film is to be fed can be selected. For example, if the feed amount and the feed speed are the same as they are in normal operation, clogging can be further inhibited. Furthermore, for example, if the feed amount and the feed speed are smaller than they are in normal operation in a range in which clogging is inhibited, the use amount of the film can be further reduced.

According to this invention, when discharging an article in a weighing machine, the article can be inhibited from getting clogged and the use amount of film can be reduced.

DETAILED DESCRIPTION

A bag-making and packaging machine 100 pertaining to an embodiment of the invention is described below. It will be noted that, in the following description, expressions such as "front (front side)," "rear (back side)," "upper," "lower," "left," and "right" are sometimes used to indicate directions and the like. Unless otherwise specified, "front," "rear," "upper," "lower," "left," and "right" here follow the directions of the arrows added to the drawings.

(1) OVERVIEW

Figure 1:
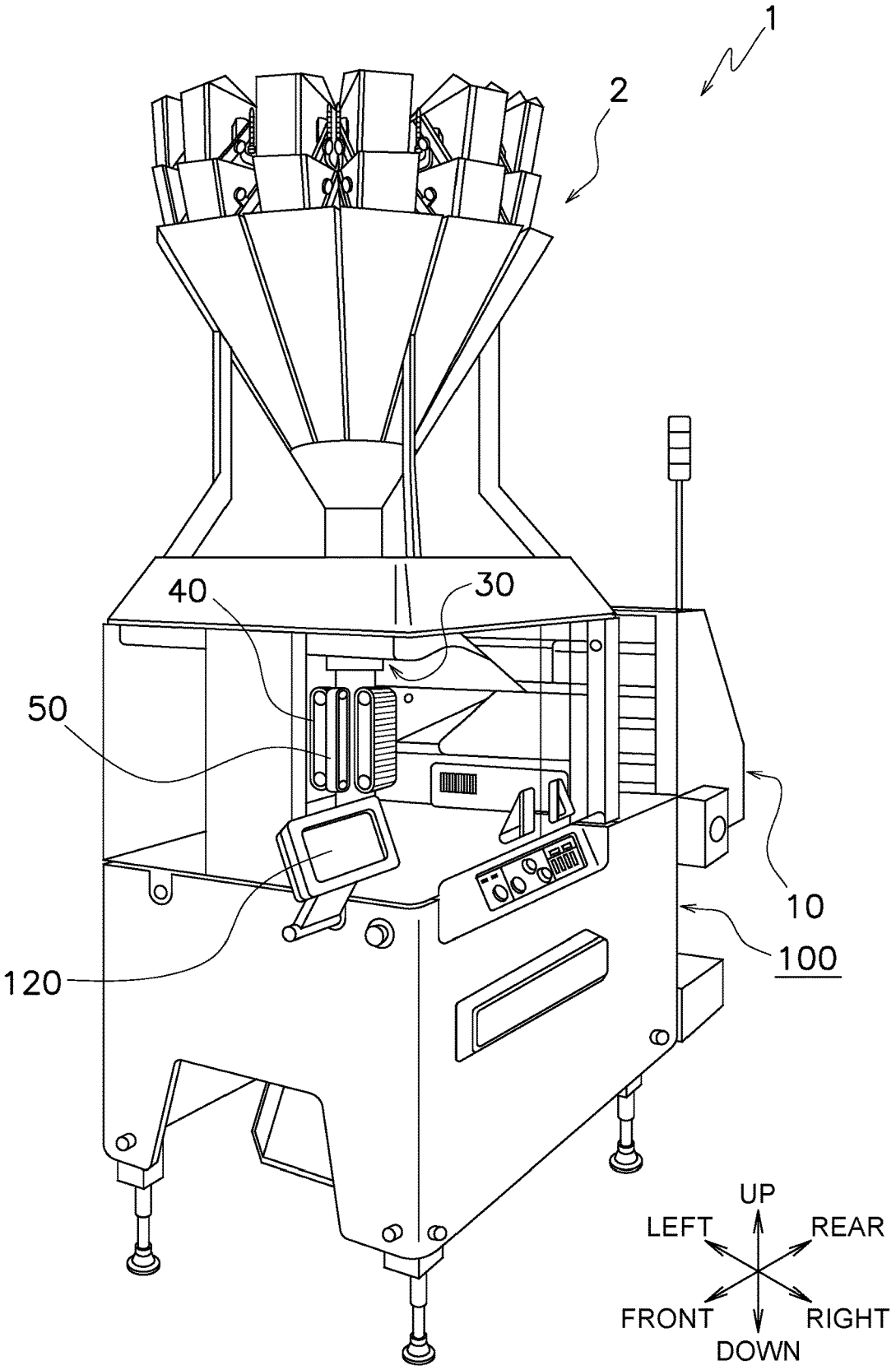
FIG. 1 is a perspective view showing a packaging machine that includes a weighing machine and a bag-making and packaging machine of an embodiment.
Figure 2:
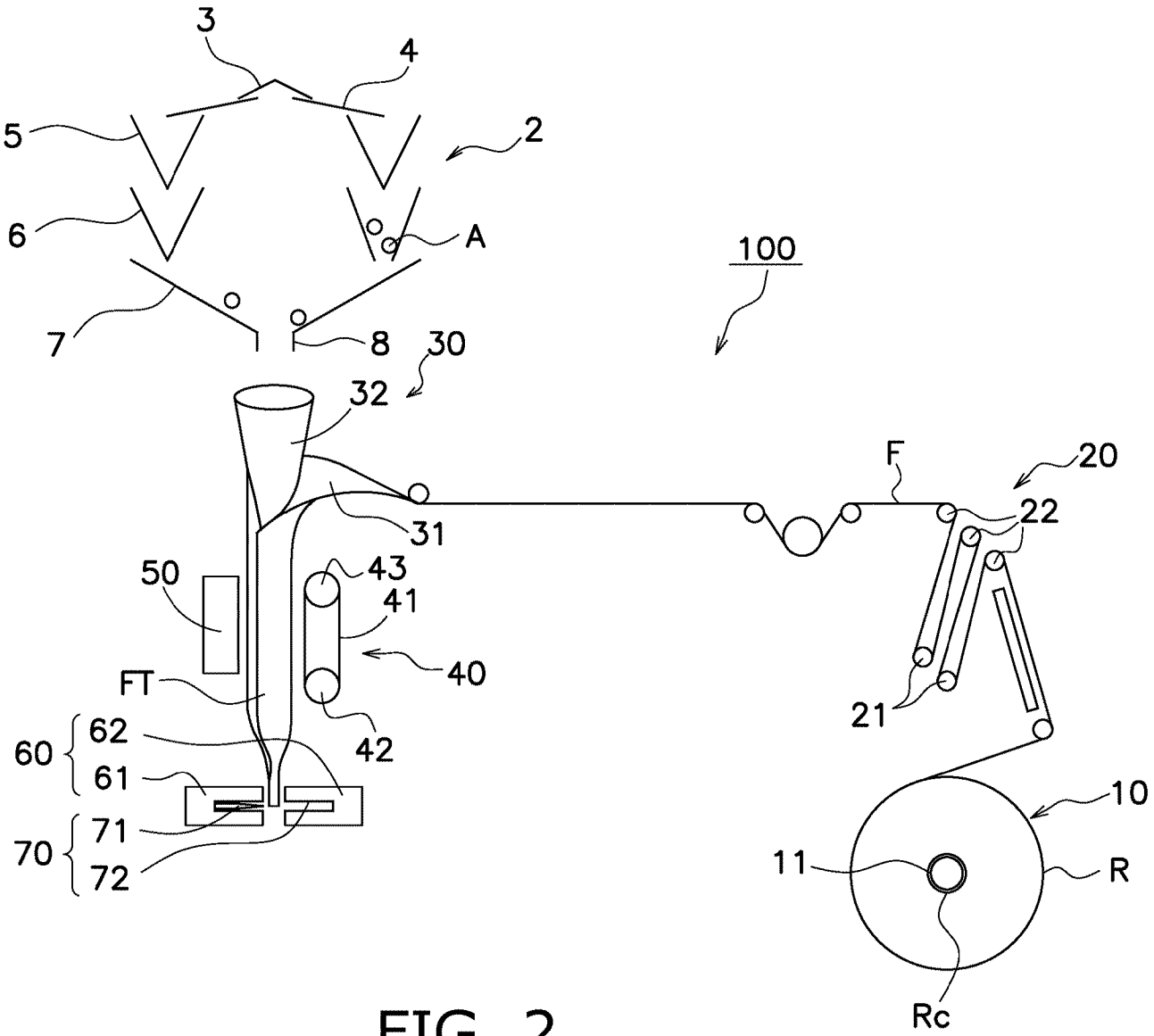
FIG. 2 is a schematic diagram showing the packaging machine that includes the weighing machine and the bag-making and packaging machine of the embodiment.

FIG. 1 is a perspective view of a weighing machine 2 and a bag-making and packaging machine 100 of this embodiment. FIG. 2 is a schematic diagram of the weighing machine 2 and the bag-making and packaging machine 100. In FIG. 1 and FIG. 2, a packaging machine 1 includes the weighing machine 2 and the bag-making and packaging machine 100.

As shown in FIG. 1 and FIG. 2, the bag-making and packaging machine 100 is installed under the weighing machine 2. The weighing machine 2 weighs one or more articles (article A) that is put into each bag. The article A is not particularly limited, and here it is a food such as potato chips. The bag-making and packaging machine 100 receives the article A discharged from the weighing machine 2 disposed upstream and packages the article A in a film F that has been formed in a tubular shape (hereafter also called "the tubular film FT") to thereby manufacture the one or more bags.

(2) DETAILED CONFIGURATIONS

(2-1) Weighing Machine

Figure 3:
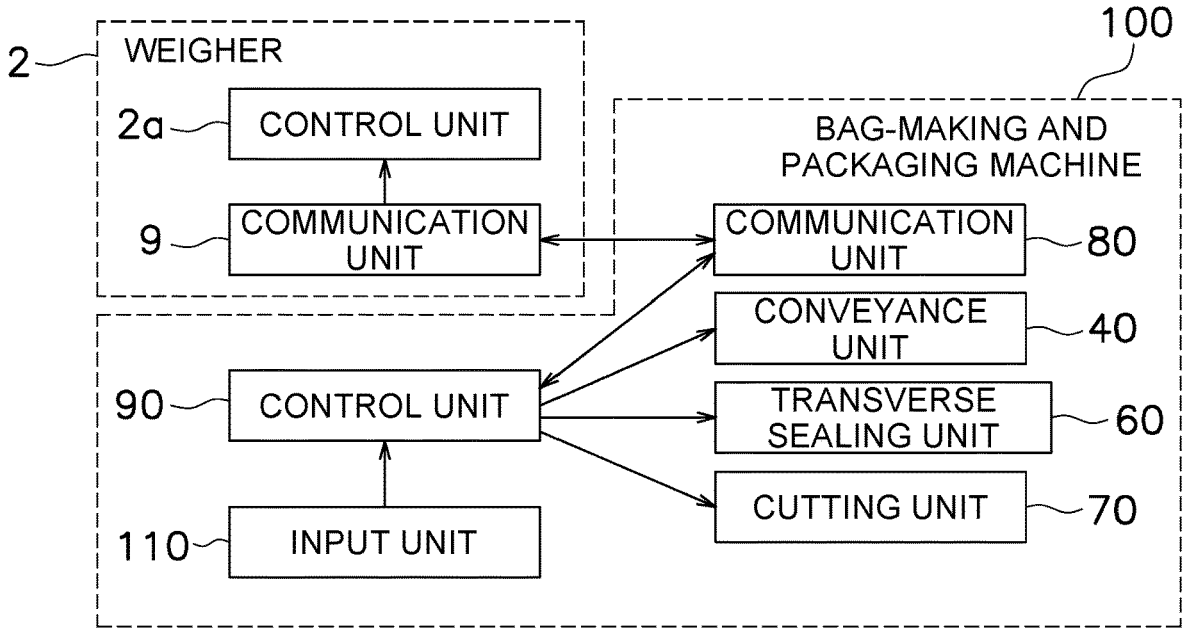
FIG. 3 is a block diagram of the weighing machine and the bag-making and packaging machine of the embodiment.

As shown in FIG. 1 and FIG. 2, the weighing machine 2 weighs the article A supplied from a conveyance unit (not shown in the drawings) to reach a target weight value and supplies the article A it has weighed to the bag-making and packaging machine 100. The weighing machine 2 of this embodiment is a combination weighing machine and includes a dispersion table 3, supply feeders 4, pool hoppers 5, weigh hoppers 6, a chute 7, and a timing hopper 8 shown in FIG. 2 and a communication unit 9 shown in FIG. 3. It will be noted that FIG. 3 shows a block diagram of the bag-making and packaging machine 100 and the weighing machine 2 associated therewith.

The dispersion table 3 has a conical shape and is configured to be rotatable. The article that has dropped from the conveyance unit onto the dispersion table 3 is moved in the radial direction while being dispersed in the circumferential direction on the dispersion table 3 by rotation, and drops onto the supply feeders 4 disposed around the dispersion table 3.

The supply feeders 4 are vibrated by an electromagnetic vibrator (not shown in the drawings). The supply feeders 4 receive the article A supplied from the dispersion table 3 and utilize vibration to cause the article A they have received to move outward and drop to the downstream pool hoppers 5.

The pool hoppers 5 receive, and temporarily retain, the article A from the supply feeders 4. Provided under each of the pool hoppers 5, which are plurally arranged in the circumferential direction, is a gate (not shown in the drawings) that opens and closes a discharge opening in the lower portion of that pool hopper 5. The timing of the opening and closing of each gate is controlled by a control unit 2*a*. When the gates open, the article retained in the pool hoppers 5 drops to the downstream weigh hoppers 6.

The weigh hoppers 6 weigh the article A. Specifically, the weigh hoppers 6 receive, and temporarily retain, the article A from the pool hoppers 5. The article A in each of the weigh hoppers 6, which are plurally arranged in the circumferential direction, has its weight weighed by a load cell (not shown in the drawings). Provided under each of the weigh hoppers 6 is a gate (not shown in the drawings) that opens and closes a discharge opening in the lower portion of that weigh hopper 6. The timing of the opening and closing of each gate is controlled by the control unit 2*a*. When the gates open, the article A retained in the weigh hoppers 6 drops into the downstream chute 7.

The chute 7 is formed in a tubular shape having an inside surface with the shape of a truncated cone that tapers downward. The chute 7 is disposed in such a way that its inside surface is positioned under all the weigh hoppers 6. The inside surface of the chute 7 is a surface that receives, and guides to the bag-making and packaging machine 100, the article A discharged from the weigh hoppers 6.

The timing hopper 8 is disposed under the chute 7. Provided under the timing hopper 8 is provided a gate (not shown in the drawings) that opens and closes a discharge opening in the lower portion of the timing hopper 8. The timing of the opening and closing of the gate is controlled by the control unit 2*a*. In a state in which the gate is closed, the timing hopper 8 temporarily retains the weighed the article A discharged from the chute 7. When the gate is opened, the timing hopper 8 discharges to the bag-making and packaging machine 100 the article A it temporarily retained. Here, the timing hopper 8 discharges the article A weighed by the weighing machine 2 to a tube 32 of a forming unit 30 of the bag-making and packaging machine 100.

The communication unit 9 shown in FIG. 3 sends to the bag-making and packaging machine 100 a signal relating to the weighing and discharge of the article A. The communication unit 9 of this embodiment also receives from the bag-making and packaging machine 100 a signal relating to the weighing and discharge of the article A. Here, the communication unit 9 of the weighing machine 2 and a communication unit 80 of the bag-making and packaging machine 100 send signals to and receive signals from each other.

(2-2) Bag-Making and Packaging Machine

As shown in FIG. 2, the bag-making and packaging machine 100 works with the weighing machine 2 installed upstream to manufacture the bags containing the article A discharged from the weighing machine 2. The bag-making and packaging machine 100 includes a film roll holding unit 10 which is shown in FIG. 1 and FIG. 2, a tension adjusting mechanism 20 which is shown in FIG. 2, a forming unit 30, a conveyance unit 40, and a longitudinal sealing unit 50 which are shown in FIG. 1 and FIG. 2, a transverse sealing unit 60 and a cutting unit 70 which are shown in FIG. 2, a communication unit 80, a control unit 90, and an input unit 110 which are shown in FIG. 3, and a display unit 120 which is shown in FIG. 1.

(2-2-1) Film Roll Holding Unit

As shown in FIG. 2, the film roll holding unit 10 is a mechanism that holds a film roll R in which a sheet-like film F that is the material of the bags is wound around a roll core Rc. The film roll holding unit 10 is disposed most upstream in the conveyance path of the film F in the bag-making and packaging machine 100.

The film roll holding unit 10 has a rotating shaft 11 on which the roll core Rc of the film roll R is mounted and a roll drive motor (not shown in the drawings) that causes the rotating shaft 11 to rotate. When the roll drive motor is activated, the film F is drawn from the film roll R, and the film F that has been drawn is conveyed by the conveyance unit 40. The film F that has been drawn from the film roll R is guided by movable rollers 21 and fixed rollers 22 of the tension adjusting mechanism 20 described later and is conveyed to a former 31 of the forming unit 30.

(2-2-2) Tension Adjusting Mechanism

The tension adjusting mechanism 20 is a mechanism that adjusts the magnitude of tension that acts on the film F that is conveyed. The tension adjusting mechanism 20 has movable rollers 21, fixed rollers 22, and an encoder (not shown in the drawings).

The movable rollers 21 and the fixed rollers 22 are all freely rotatable rollers. The fixed rollers 22 are fixed to a frame (not shown in the drawings) of the bag-making and packaging machine 100, and their position does not change. The movable rollers 21 are, for example, mounted to end portions of arms (not shown in the drawings) rotatably mounted to the frame (not shown in the drawings) of the bag-making and packaging machine 100, and the position of the movable rollers 21 is configured to be changeable. The magnitude of the tension that the tension adjusting mechanism 20 causes to act on the film F that is conveyed is adjusted by the magnitude of the force that the movable rollers 21 cause to act on the film F. The encoder is configured to detect the angle of rotation, about the axis of rotation, of the arms (not shown in the drawings) to which the movable rollers 21 are mounted. When the film F of the film roll R is completely drawn, the film F exerts a large force on the movable rollers 21, whereby the arms to which the movable rollers 21 are mounted are rotated. The encoder is configured to detect the trailing end of the film F wound in the film roll R based on the movement of the arms that the encoder detects.

(2-2-3) Forming Unit 30

The forming unit 30 rounds and forms into a tubular shape the sheet-like film F. The forming unit 30 has a former 31 and a tube 32. The former 31 forms the sheet-like film F into the tubular film FT by folding the film F so that its left end portion and its right end portion overlap each other.

The former 31 is disposed surrounding the open cylinder-shaped tube 32 in its circumferential direction. The tubular film FT that has been formed by the former 31 is guided so as to wrap around the outer peripheral surface on the lower portion side of the open cylinder-shaped tube 32 and is conveyed downward in the state in which it is wrapped around the tube 32.

The tube 32 is an open cylinder-shaped member that extends in the up and down direction and whose upper and lower end portions are open. The upper portion of the tube 32 is formed in the shape of a funnel whose diameter increases toward its upper end side. The lower portion of the tube 32 is formed in a uniform diameter.

The tube 32 receives, through the opening in its upper portion, the article A that drops thereto from the weighing machine 2 above. The article A that has been input through the opening in the upper portion of the tube 32 passes through the inside of the tube 32 and is supplied through the opening in the lower portion of the tube 32 to the inside of the tubular film FT. The tube 32 functions as a guide that guides to the inside of the tubular film FT the article A that drops from above.

(2-2-4) Conveyance Unit 40

The conveyance unit 40 conveys the film F. Here, the conveyance unit 40 conveys the film F drawn from the film roll R to the former 31. Furthermore, the conveyance unit 40 conveys the tubular film FT formed by the former 31 to the transverse sealing unit 60. The conveyance unit 40 sucks hold of and conveys downward the tubular film FT wrapped around the tube 32.

The conveyance unit 40 is disposed under the former 31. Furthermore, the conveyance unit 40 is disposed on the left side (not shown in the drawings) and the right side of the tube 32.

The conveyance unit 40 has belts 41, drive rollers 42, and follower rollers 43. The belts 41 have a sucking function. The belts 41 are entrained about the drive rollers 42 and the follower rollers 43. The drive rollers 42 are coupled to roller drive motors (not shown in the drawings) and are driven by the roller drive motors. When the drive rollers 42 are driven by the drive motors in a state in which the belts 41 are sucking hold of the film F, the tubular film FT is conveyed downward.

(2-2-5) Longitudinal Sealing Unit 50

The longitudinal sealing unit 50 seals the overlapping portion of the tubular film FT in the longitudinal direction. The longitudinal sealing unit 50 has a heater (not shown in the drawings), a heater belt (not shown in the drawings) that contacts the overlapping portion of the tubular film FT, and a drive mechanism (not shown in the drawings) that drives the heater belt. The heater heats the heater belt. The drive mechanism drives the heater belt in the front and rear direction toward the tube 32 or away from the tube 32. When the heater belt is driven by the drive mechanism toward the tube 32, the overlapping portion of the tubular film FT wrapped around the tube 32 becomes pinched between the heater belt and the tube 32. The longitudinal sealing unit 50 heat-seals the overlapping portion of the tubular film FT in the longitudinal direction by pressing, with the heated heater belt, the overlapping portion of the tubular film FT against the tube 32 with a predetermined pressure. Longitudinal seal portions are formed in the bags by this sealing in the longitudinal direction.

(2-2-6) Transverse Sealing Unit 60

The transverse sealing unit 60 seals the bags by sealing in the transverse direction the portions of the tubular film FT that become the upper and lower ends of the bags. The transverse sealing unit 60 is disposed under the conveyance unit 40 and the longitudinal sealing unit 50. The transverse sealing unit 60 seals the tubular film FT in a direction intersecting the conveyance direction of the tubular film FT—more specifically, in a direction (the right and left direction) orthogonal to the conveyance direction of the tubular film FT.

The transverse sealing unit 60 has a pair of sealing jaws 61, 62 disposed in front and in back of the tubular film FT. Both the first sealing jaw 61 and the second sealing jaw 62 have heaters. The first sealing jaw 61 and the second sealing jaw 62 function as a pair when transversely sealing the tubular film FT. Specifically, when a drive mechanism not shown in the drawings is driven, the first sealing jaw 61 and the second sealing jaw 62 move toward each other. Then, the first sealing jaw 61 and the second sealing jaw 62 pinch the tubular film FT in a state in which they press against each other, and apply pressure and heat to the portions of the tubular film FT that become the upper and lower end portions of the bags to thereby transversely seal the tubular film FT. Transverse seal portions are formed in the bags by this sealing in the transverse direction.

(2-2-7) Cutting Unit 70

The cutting unit 70 cuts the end portions of the bags. Specifically, the cutting unit 70 cuts the tubular film FT at the transverse seal portions of the bags. The cutting unit 70 is provided in the transverse sealing unit 60. The cutting unit 70 includes a cutter 71 and a receiver 72. The cutter 71 is provided in the first sealing jaw 61. The receiver 72 is provided in the second sealing jaw 62. The cutter 71 can be extended and retracted. When extended, the cutter 71 is accommodated in the receiver 72. By extending the cutter 71, the tubular film FT is cut in the transverse direction at the middle portions of the transverse seal portions in the conveyance direction of the tubular film FT.

(2-2-8) Communication Unit

The communication unit 80 shown in FIG. 3 receives from the weighing machine 2 a signal relating to the weighing and discharge of the article A. The communication unit 80 of this embodiment also sends to the weighing machine 2 a signal relating to the weighing and discharge of the article A.

Specifically, the communication unit 80 receives from the communication unit 9 of the weighing machine 2 a signal indicating that the weighing machine 2 has discharged the article A it has weighed to the tube 32 of the forming unit 30. Furthermore, the communication unit 80 sends to the communication unit 9 of the weighing machine 2 a signal as a command for the weighing machine 2 to discharge the article A it has weighed to the tube 32 of the forming unit 30.

When the communication unit 80 receives from the weighing machine 2 the signal relating to the weighing and discharge of the article A, the communication unit 80 sends to the control unit 90 a signal indicating that the article A weighed by the weighing machine 2 has been discharged.

(2-2-9) Control Unit

The control unit 90 is realized by a computer. The control unit 90 includes a control arithmetic unit and a storage device. For the control arithmetic unit, a processor such as a central processing unit (CPU) or a graphics processing unit (GPU) can be used. The control arithmetic unit reads programs stored in the storage device and performs predetermined arithmetic processing in accordance with the programs. Moreover, the control arithmetic unit can write the arithmetic results to the storage device and read information stored in the storage device in accordance with the programs.

The control unit 90 has a disposal mode for disposing of the article in the weighing machine 2. The disposal mode, in contrast to a total discharge process that forcibly discharges the article that is in all the weigh hoppers, performs a process that discharges the article A that has been weighed by the weigh hoppers 6. It will be noted that the weighing machine 2, also when the disposal mode has been set, performs the same operation it performs in a normal production mode. That is, in the disposal mode, a fixed quantity of the article A that has been weighed is supplied to the bag-making and packaging machine 100. The control unit 90 controls the communication unit 80 to continuously send to the weighing machine 2 the signal to discharge the article A while the disposal mode is set.

When changing from the normal production mode to the disposal mode, the control unit 90 performs control to skip, among operations in the normal production mode, the operation of the transverse sealing unit 60 implemented in conjunction with the signal received by the communication unit 80 from the weighing machine 2. When the control unit 90 receives from the communication unit 80 the signal indicating that the article A weighed by the weighing machine 2 has been discharged, the control unit 90 sends to the transverse sealing unit 60 a signal to skip the transverse sealing operation.

The operation of the transverse sealing unit 60 is not limited to being skipped one time or more and may also be skipped two times or more. That is, when the disposal mode has been set, the control unit 90 controls the transverse sealing unit 60 to skip the transverse sealing operation a predetermined number of times in conjunction with the signal received from the weighing machine 2. Furthermore, when the disposal mode has been set, the control unit 90 may also suspend the transverse sealing operation for a fixed period of time so that the transverse sealing operation is skipped one time or more in conjunction with the signal received from the weighing machine 2.

When changing to the disposal mode, the control unit 90 performs control to skip the transverse sealing operation of the transverse sealing unit 60 automatically or using the input unit 110 described later. If automatically, when the disposal mode is set, the control unit 90 sends a command to the transverse sealing unit 60 based on the fixed period of time in which the transverse sealing operation is to be suspended or the predetermined number of times that the transverse sealing operation is to be skipped, which are determined beforehand. If using the input unit 110, the control unit 90 acquires information that has been input to the input unit 110 and, based on that information, sends a signal to the transverse sealing unit.

Furthermore, when the disposal mode has been set, the control unit 90 controls the conveyance unit 40 to perform the operation of conveying the film F or not perform the operation of conveying the film F in conjunction with the signal received from the weighing machine 2. That is, when changing to the disposal mode, the control unit 90 may control the conveyance unit 40 to perform the operation of conveying the film F in the same way as in the normal production mode or may control the conveyance unit 40 to perform a conveyance operation that differs from the one in the normal production mode. As the conveyance operation that differs from the one in the normal production mode, the conveyance unit 40 may convey the film F more slowly than the speed at which it conveys the film F in the normal production mode, or the conveyance unit 40 may suspend conveyance of the film F for a fixed period of time. Here, when the disposal mode has been set, the control unit 90 performs control to skip a predetermined number of times the operation of conveying the film F that is linked to the signal received from the weighing machine 2. That is, the control unit 90 skips the operation of conveying the film F in addition to skipping the transverse sealing operation. It will be noted that the timing when the transverse sealing operation is to be skipped and the timing when the conveyance operation is to be skipped by the control unit 90 can be freely set.

Furthermore, when the disposal mode has been set, the control unit 90 manufactures bags that are longer than the bags manufactured in the normal production mode. For example, when the disposal mode has been set, the control unit 90 manufactures bags that are twice as long as the bags manufactured in the normal production mode by controlling the conveyance unit 40 and the transverse sealing unit 60 to convey the film F at the same speed as the speed at which the film F is conveyed in the normal production mode and skipping the transverse sealing operation one time.

(2-2-10) Input Unit

Figure 4:
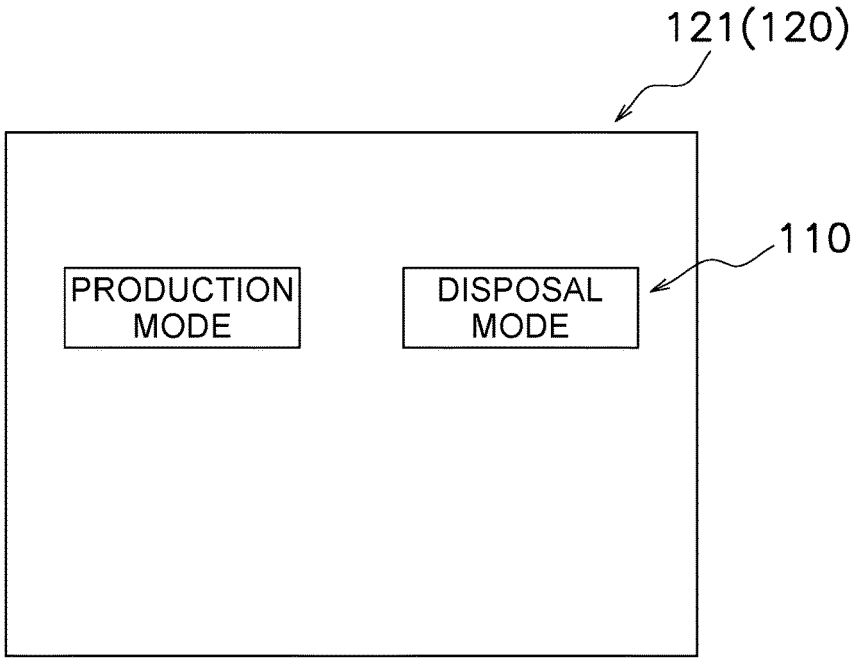
FIG. 4 is a schematic diagram showing a first screen representing an input unit of the embodiment.
Figure 5:
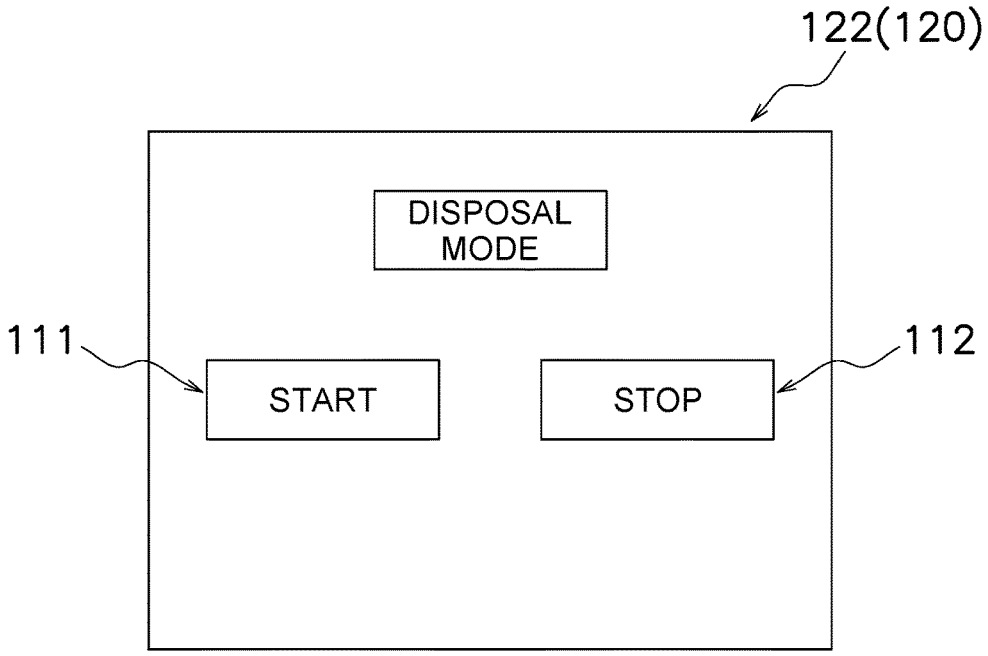
FIG. 5 is a schematic diagram showing a second screen representing the input unit of the embodiment.
Figure 6:
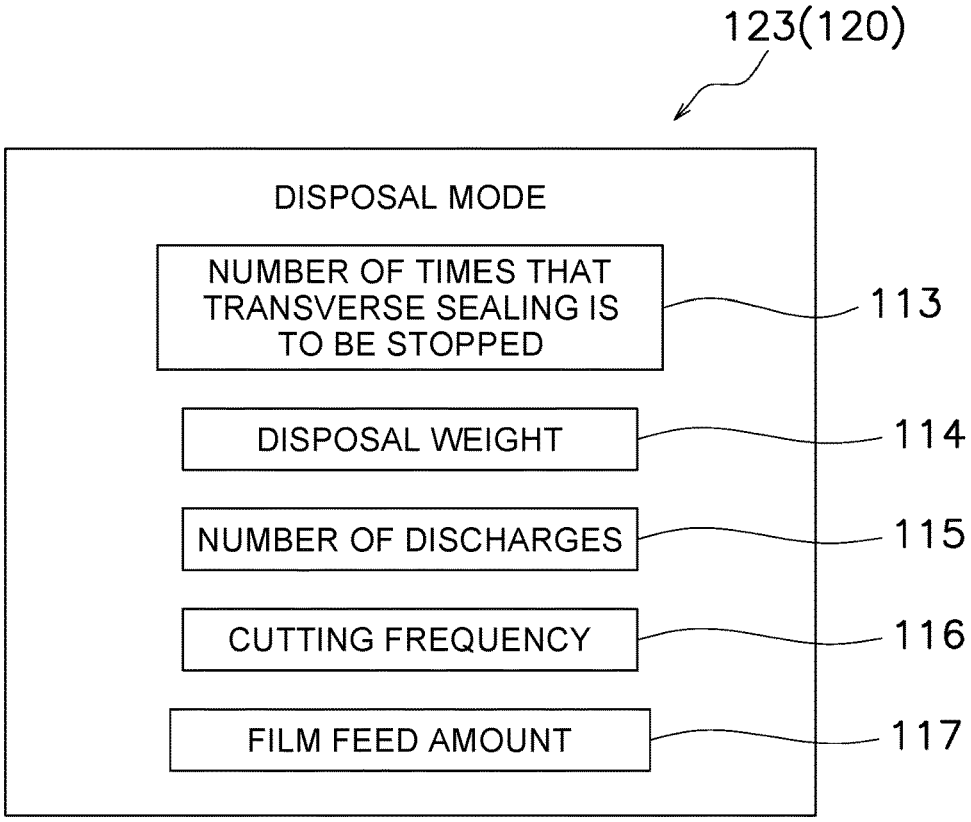
FIG. 6 is a schematic diagram showing a third screen representing the input unit of the embodiment.

The input unit 110 sets the disposal mode. Information that has been input to the input unit 110 is sent to the control unit 90. As shown in FIG. 4 to FIG. 6, the input unit 110 of this embodiment is provided in the display unit 120 described later. Here, the input unit 110 comprises buttons provided on one screen of the display unit 120. It will be noted that FIG. 4 to FIG. 6 schematically show first to third screens 121 to 123 of the display unit 120.

As shown in FIG. 4, during normal operation a button marked with the normal "Production Mode" is pressed on the first screen 121. The user can change from the normal production mode to the disposal mode by pressing a button marked "Disposal Mode" serving as the input unit 110.

When the button marked "Disposal Mode" is pressed, the second screen 122 shown in FIG. 5 is displayed. The second screen 122 is provided with buttons for selecting whether to start or stop the disposal mode. When the user presses a start button 111 marked "START," the disposal mode is started. When the user presses a stop button 112 marked "STOP," the disposal mode is stopped. When the disposal mode is set to start or stop by the input unit 110, that information is sent to the control unit 90.

When the start button 111 is pressed, the third screen 123 shown in FIG. 6 is displayed. On the third screen 123, select operations in the disposal mode can be selected.

Specifically, on the third screen 123, the input unit 110 allows the user to input the number of times that the transverse sealing operation by the transverse sealing unit 60 is to be stopped (skipped). Furthermore, the input unit 110 allows the user to input the weight per discharge of the article A from the weighing machine 2. Furthermore, the input unit 110 allows the user to input the number of times per bag that the article A is to be discharged from the weighing machine 2. Furthermore, the input unit 110 allows the user to input the frequency of the cutting operation by the cutting unit 70. The input unit 110 allows the user to input the amount of the film F that is to be fed, and/or the speed at which the film F is to be fed, by the conveyance unit 40.

Specifically, when the user presses a button 113 marked "Number of Times that Transverse Sealing is to be Stopped" on the third screen 123, the display unit 120 switches to a fourth screen (not shown in the drawings) that allows the user to input the number of times that the transverse sealing operation by the transverse sealing unit 60 is to be stopped. On the fourth screen, the user inputs the number of times that the operation of the transverse sealing unit 60 is to be skipped. The number of times that the transverse sealing operation is to be skipped is one time or more.

Furthermore, when the user presses a button 114 marked "Disposal Weight" on the third screen 123, the display unit 120 switches to a fifth screen (not shown in the drawings) that allows the user to input the weight per discharge of the article A from the weighing machine 2. On the fifth screen, the user inputs the weight per discharge of the article A from the weighing machine 2. The weight is a numerical value that is the same as, or exceeds, what it was during operation prior to the change in a range in the normal production mode.

Furthermore, when the user presses a button 115 marked "Number of Discharges" on the third screen 123, the display unit 120 switches to a sixth screen (not shown in the drawings) that allows the user to input the number of times per bag that the article A is to be discharged from the weighing machine 2. On the sixth screen, the user inputs the number of times per bag that the article A is to be discharged from the weighing machine 2. The number of times is a numerical value that is the same as, or exceeds, what it was during operation prior to the change in a range in the normal production mode. For example, when "two times" is input for the number of times, the control unit 90 controls the conveyance unit 40 to convey the film F one bag's length when two discharges of the article from the weighing machine 2 are performed.

Furthermore, when the user presses a button 116 marked "Cutting Frequency" on the third screen 123, the display unit 120 switches to a seventh screen (not shown in the drawings) that allows the user to input the frequency of the cutting operation by the cutting unit 70. On the seventh screen, the user inputs the frequency of the cutting operation by the cutting unit 70. The cutting frequency is lower than it is in the normal production mode. Here, the seventh screen allows the user to input the number of times that the operation of the cutting unit 70 is to be skipped. The number of times that the cutting operation is to be skipped is one time or more.

Furthermore, when the user presses a button 117 marked "Film Feed Amount" on the third screen 123, the display unit 120 switches to an eighth screen (not shown in the drawings) that allows the user to input the amount of the film that is to be fed, and/or the speed at which the film is to be fed, by the conveyance unit 40. On the eighth screen, the user inputs the amount of the film that is to be fed, and/or the speed at which the film is to be fed, by the conveyance unit 40. The feed amount is the same as or less than it is in the normal production mode. The feed speed is the same as or slower than it is in the normal production mode.

(2-2-11) Display Unit

The display unit 120 shown in FIG. 1 allows the user to control the operation of the bag-making and packaging machine 100 and displays operating conditions of the bag-making and packaging machine 100. The display unit 120 is, for example, a liquid crystal display. The display unit 120 has plural screens as shown in FIG. 4 to FIG. 6. The first screen 121 shown in FIG. 4 allows the user to select the normal production mode or the disposal mode. The second screen 122 shown in FIG. 5 allows the user to select whether to start or stop the disposal mode. The third screen 123 shown in FIG. 6 allows the user to select operations in the disposal mode.

(3) OPERATION OF BAG-MAKING AND PACKAGING MACHINE 100

(3-1) Normal Production Mode

First, the operations of the weighing machine 2 and the bag-making and packaging machine 100 in the normal production mode will be described.

(3-1-1) Operation of Weighing Machine

As shown in FIG. 2, proper quantities of the article A are successively input onto the dispersion table 3 from the conveyance unit (not shown in the drawings) of the weighing machine 2. The article that has been input onto the dispersion table 3 is moved on the dispersion table 3 by the rotation of the dispersion table 3 and drops onto the supply feeders 4 disposed in a circle around the dispersion table 3. The article A that has dropped onto the supply feeders 4 is moved on the supply feeders 4 by the vibration of the supply feeders 4 and drops into the pool hoppers 5 disposed around the supply feeders 4. At this time, the gates of the pool hoppers 5 are in a closed state, and the article A is retained in the pool hoppers 5.

Then, the gates of the pool hoppers 5 are controlled to open in a case where the article A is not being retained in the weigh hoppers 6 disposed under those gates. Because of this, the article A that had been retained in the pool hoppers 5 is discharged into the weigh hoppers 6 downstream of the pool hoppers 5. At this time, the gates of the weigh hoppers 6 are all in a closed state, and the article A is retained in the weigh hoppers 6. The load cells perform measurement at the timing when the article A is being retained in the weigh hoppers 6 corresponding to those load cells.

A combinational arithmetic process is executed based on a signal from the bag-making and packaging machine 100, and several of the weigh hoppers 6 are selected from among the plural weigh hoppers 6. "Combinational arithmetic process" refers to combining and adding together the weight values of the article being retained in each of the weigh hoppers 6 to find a combination of the article whose total weight value falls within a predetermined range. When several of the weigh hoppers 6 are selected by the combinational arithmetic process, the gates that open and close the discharge openings in the selected weigh hoppers 6 are controlled to open, and the article A that had been retained in the weigh hoppers 6 is discharged into the chute 7. Then, the weigh hoppers 6 that have become empty as a result of discharging the article A into the chute 7 are successively replenished with new article A from the upstream pool hoppers 5.

The article A that collects while sliding down through the chute 7 is discharged into the timing hopper 8. At this time, the gate of the timing hopper 8 is in a closed state, and the article A is retained in the timing hopper 8. The gate of the timing hopper 8 is controlled to open in accordance with the timing when the article A is to be supplied to the bag-making and packaging machine 100 disposed under the gate. Because of this, the article A that had been retained in the timing hopper 8 is conveyed to the bag-making and packaging machine 100 downstream of the weighing machine 2.

(3-1-2) Operation of Bag-making and Packaging Machine

The sheet-like film F drawn from the film roll FR held in the film roll holding unit 10 is guided by the movable rollers 21 and the fixed rollers 22 of the tension adjusting mechanism 20 and conveyed by the conveyance unit 40 to the forming unit 30. The tension adjusting mechanism 20 uses the movable rollers 21 to cause force to act on the film F to thereby adjust the tension in the film F that is conveyed. The former 31 of the forming unit 30 forms the sheet-like film F into a tubular shape to form the tubular film FT. The tubular film FT is conveyed downward by the conveyance unit 40, and the overlapping portion of the tubular film FT is sealed in the longitudinal direction by the longitudinal sealing unit 50. The tubular film FT in which the longitudinal seal portion has been formed by the longitudinal sealing unit 50 is conveyed further downward by the conveyance unit 40, and the portion of the tubular film FT that becomes the upper and lower ends of the bags is sealed in the transverse direction by the transverse sealing unit 60. The bag in which the transverse seal portion has been formed by the transverse sealing unit 60 has its transverse seal portion cut in the transverse direction by the cutter 71 of the cutting unit 70, whereby a bag is manufactured.

The article A discharged from the weighing machine 2 is supplied to the tube 32 of the forming unit 30. The inside of the tubular film FT that becomes the bag is supplied with the article A through the tube 32 of the forming unit 30 before the tubular film FT is sealed by the transverse sealing unit 60. As a result, in the bag-making and packaging machine 100, a bag containing the article A is manufactured. The bag manufactured by the bag-making and packaging machine 100 is, for example, conveyed to a downstream process by a conveyor disposed under the transverse sealing unit 60.

(3-2) Disposal Mode

Next, the operations of the weighing machine 2 and the bag-making and packaging machine 100 when the control unit 90 has been changed from the normal production mode to the disposal mode will be described. Here, a case where the disposal mode has been set by the input unit 110 will be described.

When the disposal mode is set by the input unit 110 of the bag-making and packaging machine 100, the control unit 90 controls the communication unit 80 to send to the weighing machine 2 the signal to discharge the article A. The communication unit 9 of the weighing machine 2 that has received this signal sends it to the control unit 2*a* of the weighing machine 2, and the control unit 2*a* of the weighing machine 2 performs control to discharge a predetermined quantity of the article A to the bag-making and packaging machine 100. Furthermore, the communication unit 9 of the weighing machine 2 sends to the communication unit 80 of the bag-making and packaging machine 100 the signal relating to the weighing and discharge of the article A. The communication unit 80 receives from the weighing machine 2 the signal relating to the weighing and discharge of the article. Then, the control unit 90 of the bag-making and packaging machine 100 performs control to skip, among operations in the normal production mode, the operation of the transverse sealing unit 60 implemented in conjunction with the signal received by the communication unit 80 from the weighing machine 2.

Specifically, when the button marked "Disposal Mode" is pressed on the display unit 120 shown in FIG. 4, the display unit 120 switches to the second screen shown in FIG. 5. When the start button 111 marked "START" is pressed on the second screen, the disposal mode is started and the display unit 120 switches to the third screen 123 shown in FIG. 6. On the third screen 123, at least one of the number of times that transverse sealing is to be stopped, the discharge weight, the number of discharges, the cutting frequency, and the film feed amount is input.

Specifically, when the button 113 marked "Number of Times that Transverse Sealing is to be Stopped" is pressed on the third screen 123, the number of times that the transverse sealing operation by the transverse sealing unit 60 is to be stopped is input. The control unit 90 that has acquired this information performs control to skip the operation of the transverse sealing unit 60 the number of times that has been input. In this case, if the conveyance operation by the conveyance unit 40 is the same as it is in normal operation, a bag that is longer than the bags manufactured in normal operation is manufactured. Furthermore, in a case where the conveyance operation by the conveyance unit 40 is slower than it is in normal operation, and/or in a case where the weight of the article A to be discharged from the weighing machine 2 is greater than it is in normal operation, the quantity of the article A put into the tubular film FT manufactured in normal operation can be increased.

Furthermore, when the button 114 marked "Disposal Weight" is pressed on the third screen 123, the weight per discharge of the article A from the weighing machine 2 is input. The control unit 90 that has acquired this information controls the communication unit 80 to send a signal to cause the weighing machine 2 to discharge the weight that has been input.

Furthermore, when the button 115 marked "Number of Discharges" is pressed on the third screen 123, the number of times per bag that the article A is to be discharged from the weighing machine 2 is input. The control unit 90 that has acquired this information controls the communication unit 80 to send a signal to cause the weighing machine 2 to discharge the number of times that has been input.

Furthermore, when the button 116 marked "Cutting Frequency" is pressed on the third screen 123, the frequency of the cutting operation by the cutting unit 70 is input. The control unit 90 that has acquired this information performs control to skip the operation of the cutting unit 70 the number of times that has been input.

Furthermore, when the button 117 marked "Film Feed Amount" is pressed on the third screen 123, the amount of the film that is to be fed, and/or the speed at which the film is to be fed, by the conveyance unit 40 is input. The control unit 90 that has acquired this information controls the operation of the conveyance unit 40 based on the feed amount and/or the feed speed that has been input.

In this way, the control unit 90 implements the disposal mode based on at least one of the number of times that transverse sealing is to be stopped, the discharge weight, the number of discharges, the cutting frequency, and the film feed amount. Here, the control unit 90 performs control to skip the transverse sealing operation of the transverse sealing unit 60 and skip the cutting operation of the cutting unit 70 in the normal production mode. That is, the control unit 90 performs control to skip the transverse sealing operation of the transverse sealing unit 60 and the cutting operation of the cutting unit 70 and continuously implement the normal weighing operation and bag-making operation.

When the article A is all discharged from the weighing machine 2, the communication unit 9 of the weighing machine 2 sends a signal indicating this to the communication unit 80 of the bag-making and packaging machine 100. The communication unit 80 that has received this signal sends to the control unit 90 a signal indicating that there is no article A to dispose of. The control unit 90 that has received this signal ends the disposal mode. It will be noted that when the stop button 112 marked "STOP" is pressed on the second screen 122 shown in FIG. 5, it is also possible for the control unit 90 that has acquired the information to stop the disposal mode from the input unit 110 to end the disposal mode.

(4) CHARACTERISTICS

4-1

The bag-making and packaging machine 100 of this embodiment works with the weighing machine 2 installed upstream to manufacture bags containing the article A discharged from the weighing machine 2. The bag-making and packaging machine 100 includes the forming unit 30, the transverse sealing unit 60, the conveyance unit 40, the communication unit 80, and the control unit 90. The forming unit 30 forms the film F into a tubular shape. The transverse sealing unit 60 transversely seals the film F that has been formed into the tubular shape. The conveyance unit 40 conveys the film F. The communication unit 80 receives from the weighing machine 2 a signal relating to weighing and discharge of the article A. The control unit 90 has a disposal mode for disposing of the article A in the weighing machine 2. When changing from the normal production mode to the disposal mode, the control unit 90 performs control to skip, among operations in the normal production mode, the operation of the transverse sealing unit 60 implemented in conjunction with the signal received by the communication unit 80 from the weighing machine 2.

According to the bag-making and packaging machine 100 of this embodiment, the control unit 90 of the bag-making and packaging machine 100 has the disposal mode for disposing of the article in the weighing machine 2, and when changing to the disposal mode, the control unit 90 performs control so that the article A is discharged in the normal production mode from the weighing machine 2. Because of this, the article A is discharged from the weighing machine 2 in the same way it is in the normal production mode in which clogging is unlikely to occur. That is, even when the disposal mode is set, the control unit 90 performs control to have the weighing machine 2 discharge the article A a little at a time in the same way as in the normal production mode. In this way, the bag-making and packaging machine 100 in the disposal mode requests the weighing machine 2 to discharge the article A a predetermined quantity at a time. For this reason, even when there is a lot of the article A remaining in the weighing machine, compared to the conventional total discharge process that forcibly discharges at one time all the article that is in the weigh hoppers, the article can be inhibited from getting clogged inside the bag-making and packaging machine 100. Consequently, when discharging the article A in the weighing machine 2, the article A can be inhibited from getting clogged.

Furthermore, when changing to the disposal mode, the control unit 90 performs control to skip the operation of the transverse sealing unit 60. For this reason, in a case where the conveyance operation is the same as it is in the normal production mode, compared to the normal production mode, in the disposal mode a lot of the article A discharged from the weighing machine 2 can be accommodated. Consequently, when discharging the article A in the weighing machine 2, the use amount of the film F can be reduced.

In this way, the bag-making and packaging machine 100 of this embodiment can, when discharging the article A in the weighing machine 2, inhibit the article A from getting clogged and reduce the use amount of the film F. From this standpoint, it is preferred that, when the disposal mode has been set, the control unit 90 control the communication unit 80 to send to the weighing machine 2 a signal to discharge the article A, control the conveyance unit 40 to continue the operation of conveying the film F, and control the transverse sealing unit 60 to skip the transverse sealing operation.

4-2

In this embodiment, when the disposal mode has been set, the control unit 90 performs control to skip a predetermined number of times the operation of conveying the film F that is linked to the signal that the communication unit 80 receives.

Here, the control unit 90 in the disposal mode controls the operation of conveying the film F. By making the operation of conveying the film F slower than it is in normal operation, a lot of the article A to be disposed of can be accommodated in the film F. For this reason, the use amount of the film in the disposal mode can be reduced.

Moreover, when the disposal mode has been set, the control unit 90 sends to the conveyance unit 40 a command to have it perform the operation of conveying the film F, whereby the article A can be inhibited by the conveyance of the film F from overflowing the bag.

4-3

In this embodiment, when the disposal mode has been set, the control unit 90 controls the transverse sealing unit 60 to suspend the transverse sealing operation for a fixed period of time or skip the transverse sealing operation a predetermined number of times, in conjunction with the signal that the communication unit 80 receives.

Here, in the disposal mode the transverse sealing operation is performed fewer times than it is in normal operation, so in the case of performing the same conveyance operation as in normal operation, bags that are longer than they are in normal operation can be manufactured. For this reason, the bags manufactured in the disposal mode are different from the bags manufactured in normal operation, so the bags manufactured in the disposal mode and the bags manufactured in normal operation can be easily distinguished from each other.

4-4

The bag-making and packaging machine 100 of this embodiment further includes the input unit 110 that sets the disposal mode. With the input unit 110, the user can easily realize the disposal mode.

4-5

In this embodiment, the input unit 110 allows a user to input the number of times that the transverse sealing operation by the transverse sealing unit 60 is to be stopped. Here, in the disposal mode the number of times that the transverse sealing operation is to be stopped can be selected. For example, if the number of times that the transverse sealing operation is to be stopped is one time or more in a range in which clogging is inhibited, in the case of performing the same conveyance operation as in normal operation, bags that are longer than they are in normal operation can be manufactured. For this reason, the bags to be disposed of can be easily distinguished.

4-6

In this embodiment, the input unit 110 allows a user to input the weight per discharge of the article A from the weighing machine 2. Here, in the disposal mode the weight in which the article is discharged from the weighing machine 2 can be selected. For example, if the weight is about the same as it is in normal operation, clogging can be further inhibited in the same way as in normal operation. Furthermore, for example, if the weight is greater than it is in normal operation in a range in which clogging is inhibited, in the case of performing the same conveyance operation as in normal operation, the use amount of the film F can be reduced.

4-7

In this embodiment, the input unit 110 allows a user to input the number of times per bag that the article A is to be discharged from the weighing machine 2. Here, in the disposal mode the number of times that the article A is to be discharged from the weighing machine 2 can be selected. For example, if the number of times is the same as it is in normal operation, clogging can be further inhibited in the same way as in normal operation. Furthermore, for example, if the number of times is greater than it is in normal operation in a range in which clogging is inhibited, in the case of performing the same conveyance operation as in normal operation, the use amount of the film F can be further reduced.

4-8

The bag-making and packaging machine 100 of this embodiment further includes the cutting unit 70 that cuts the portion of the film F that the transverse sealing unit 60 has transversely sealed. The input unit 110 allows a user to input the frequency of the cutting operation by the cutting unit 70.

Here, in the disposal mode the frequency of the cutting operation can be selected. For example, if the cutting frequency is the same as it is in normal operation, clogging can be further inhibited. Furthermore, for example, if the cutting frequency is higher than it is in normal operation in a range in which clogging is inhibited, in the case of performing the same conveyance operation as in normal operation, bags that are longer than they are in normal operation can be manufactured.

4-9

In this embodiment, the input unit 110 allows a user to input the amount of the film F to be fed, and/or the speed at which the film F is to be fed, by the conveyance unit 40. Here, in the disposal mode the amount of the film F to be fed and/or the speed at which the film F is to be fed can be selected. For example, if the feed amount and the feed speed are the same as they are in normal operation, clogging can be further inhibited. Furthermore, for example, if the feed amount and the feed speed are smaller than they are in normal operation in a range in which clogging is inhibited, the use amount of the film F can be further reduced.

(5) EXAMPLE MODIFICATIONS

Example modifications of the above embodiment are described below. It will be noted that some or all of the content of each example modification may be combined with the content of the above embodiment and/or the content of another example modification to the extent that they are not incompatible with each other.

(5-1) Example Modification A

In the above embodiment, when the disposal mode has been set, the control unit 90 performs control to manufacture bags that are longer than they normally are, but the control unit 90 is not limited to this. The control unit 90 may also perform control to skip one time the operation of the transverse sealing unit 60 and reduce the speed at which the film F is conveyed by the conveyance unit 40 to half of what it is in the normal production mode, to thereby manufacture, in the disposal mode, bags that are the same as they are in normal operation.

REFERENCE SIGNS LIST

1 Packaging Machine
2 Weighing machine
30 Forming Unit
40 Conveyance Unit
50 Longitudinal Sealing Unit
60 Transverse Sealing Unit
70 Cutting Unit
80 Communication Unit
90 Control Unit
100 Bag-making and Packaging Machine
110 Input Unit
A Article
F, FT Film

What is claimed is:

1. A bag-making and packaging machine configured to work with a weighing machine installed upstream thereof to manufacture a bag containing an article discharged from the weighing machine, the bag-making and packaging machine comprising:

a forming unit that forms a film into a tubular shape;

a transverse sealing unit that transversely seals the film that has been formed into the tubular shape;

a conveyance unit that conveys the film;

a control unit that controls the bag-making and packaging machine to operate in a normal production mode and in a disposal mode; and a communication unit adapted to send to the weighing machine a signal relating to discharge therefrom of the article;

wherein the control unit is configured to control operation of the bag-making and packaging machine such that during operation in the normal production mode, the bag-making and packaging machine receives the article discharged from the weighing machine after the signal has been sent and the transverse sealing unit is operated without skipping operation of the transverse sealing unit to manufacture the bag in which the transverse seal is formed from the tubular film, and during operation in the disposal mode, the bag-making and packaging machine receives the article discharged from the weighing machine after the signal has been sent and the transverse sealing unit is operated to skip a predetermined number of times the operation of the transverse sealing unit so as to manufacture a plurality of the bags that are longer than the length of the bag manufactured in the normal production mode, and to divide the article present in the weighing machine into the plurality of the bags and discharge the plurality of the bags.

2. The bag-making and packaging machine according to claim 1, wherein when the disposal mode has been set, the control unit performs control to skip a predetermined number of times the operation of conveying the film that is linked to the signal.

3. The bag-making and packaging machine according to claim 1, wherein when the disposal mode has been set, the control unit controls, in conjunction with the signal, the transverse sealing unit to suspend the transverse sealing operation for a fixed period of time or skip the transverse sealing operation a predetermined number of times.

4. The bag-making and packaging machine according to claim 1, further comprising an input unit that sets the disposal mode.

5. The bag-making and packaging machine according to claim 4, wherein the input unit allows a user to input a number of times that the transverse sealing operation by the transverse sealing unit is to be stopped.

6. The bag-making and packaging machine according to claim 4, wherein the input unit allows a user to input the weight per discharge of the article from the weighing machine.

7. The bag-making and packaging machine according to claim 4, wherein the input unit allows a user to input the number of times per bag that the article is to be discharged from the weighing machine.

8. The bag-making and packaging machine according to claim 4, further comprising a cutting unit that cuts the portion of the film that the transverse sealing unit has transversely sealed, wherein the input unit allows a user to input a frequency of the cutting operation by the cutting unit.

9. The bag-making and packaging machine according to claim 4, wherein the input unit allows a user to input an amount of the film that is to be fed, and/or a speed at which the film is to be fed, by the conveyance unit.

* * * * *